US006933474B2

(12) United States Patent
Shukla et al.

(10) Patent No.: US 6,933,474 B2
(45) Date of Patent: Aug. 23, 2005

(54) ELECTRONIC POWER CONTROL FOR COOKTOP HEATERS

(75) Inventors: Sanjay Shukla, Hendersonville, TN (US); James E. Pryor, Clarksville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 297 days.

(21) Appl. No.: 10/118,294

(22) Filed: Apr. 8, 2002

(65) Prior Publication Data

US 2003/0094448 A1 May 22, 2003

Related U.S. Application Data

(63) Continuation-in-part of application No. 09/973,096, filed on Oct. 9, 2001, now abandoned.

(51) Int. Cl.[7] ..... H05B 1/02

(52) U.S. Cl. ..... 219/487; 219/505; 219/504; 219/483; 307/39

(58) Field of Search ..... 219/490–497, 219/501, 505, 483–489, 507–515; 307/39–41

(56) References Cited

U.S. PATENT DOCUMENTS 3,903,395 A * 9/1975 Hamstra ..... 219/497
4,052,591 A 10/1977 Sekera, Jr. et al.
4,849,595 A * 7/1989 Fowler ..... 219/719
4,891,497 A 1/1990 Yoshimura
5,191,190 A 3/1993 Dodson
5,451,746 A * 9/1995 Kadwell et al. ..... 219/506
5,662,465 A * 9/1997 Kano ..... 431/12
5,710,409 A 1/1998 Schwarzbäcker et al.
5,786,996 A 7/1998 Vitkus et al.
5,841,112 A * 11/1998 Brooks et al. ..... 219/506
5,947,370 A * 9/1999 Rona et al. ..... 236/204
5,981,916 A 11/1999 Griffiths et al.
6,111,231 A 8/2000 Corson et al.
6,191,391 B1 2/2001 Deo et al.
6,198,080 B1 3/2001 Rice et al.

* cited by examiner

*Primary Examiner*—Mark Paschall
(74) *Attorney, Agent, or Firm*—Pearne & Gordon LLP

(57) ABSTRACT

A power control system for an electric cooktop. The power level is set by a knob connected to a potentiometer. Potentiometer information is digitally communicated by a controller over a serial communication bus to a power unit. The power unit communicates power level display information back to the controller over the same serial communication bus. The display information is displayed as numbers on a digital display by the controller. The power unit controls a heating element of the cooktop according to the potentiometer information. A second potentiometer can be added to control a second heating element by operating as a slave to the first controller. Further, multiple heating elements can be controlled by a single potentiometer by dividing the angular rotation into multiple segments or ranges.

27 Claims, 9 Drawing Sheets

ELECTRONIC POWER CONTROL FOR COOKTOP HEATERS

BACKGROUND OF THE INVENTION

The present invention relates to the field of electronic controls and more specifically to an electronic power control system for cooktop heating elements.

Conventional controls for electric cooktops utilize so-called "infinite switches." The infinite switch comprises a bimetal switch to control an electric heating element. Current flowing in the bimetal switch causes it to physically move through a process of heating and cooling. This movement causes the switch contacts to open and close, thereby, controlling the power applied to the heating element.

The infinite switch uses pulse width modulation to control the power output, and thus the temperature of the heating element. Rotation of the infinite switch changes the relationship of the closed and open times or duty cycle. As the switch is rotated to a higher setting the contacts remain closed for a longer period of time, raising the heating element temperature. Conversely, rotating the switch to a lower setting causes the contacts to remain closed for a shorter period of time, lowering the heating element temperature.

Recently, electronic controls have been increasing in popularity. Electronic controls are capable of providing a more precise level of heating. Further, associated digital controls are easier to read than an analog dial, allowing the quick setting of desired heat levels. Electronic controls are also capable of providing advanced features, such as a safety lockout.

Analog controls remain desirable because their associated rotational control knobs are often easier to manipulate and more convenient for the user than the button-type controls conventionally associated with electronic controls. Likewise, using a duty cycle to control the level of heating remains desirable, because it allows the heating elements to provide very low levels of heat, including levels suitable for warming operations.

BRIEF SUMMARY OF THE INVENTION

The present invention provides a power control system for an electric heating element. The control system comprises a communication bus, a controller connected to the communication bus, a variably resistive device connected to the controller, a digital display connected to the controller, and a power unit connected to the communication bus, the power unit having a power output.

According to another aspect, the present invention provides a method of controlling a power output comprising the steps of: inputting power setting information to an electronic controller by a variably resistive device, and adjusting a duty cycle of a power output by the electronic controller according to the angular position of the variably resistive device.

According to yet another aspect, the present invention provides a power control system for controlling a plurality of heating elements. The control system comprises a first rotational control input having a first range of angular rotation and a second range of angular rotation, a first heating element, and a second heating element. A position of the control input in the first range controls the first heating element and a position of the control input in the second range controls the second heating element.

According to a further aspect, the present invention provides a power control system for controlling a plurality of heating elements. The control system comprises a first rotational control input, a second rotational control input having a first range of angular rotation and a second range of angular rotation, a first heating element, a second heating element, and a third heating element. The second heating element is a bridge element positioned between the first element and the third element. The first control input controls the first heating element. A position of the second control input in the first range controls the third heating element, and a position of the second control input in the second range causes the first control input to concurrently control the first heating element, the second heating element, and the third heating element.

According to a further aspect, the present invention provides a method of controlling a plurality of power outputs comprising steps of: inputting power setting information to an electronic controller by a variably resistive device, the electronic controller adjusting a duty cycle of a first power output according to a position in a first predetermined range of positions of the variably resistive device, and the electronic controller adjusting a duty cycle of a second power output according to position in a second predetermined range of positions of the variably resistive device.

DETAILED DESCRIPTION OF THE INVENTION

Figure 1:
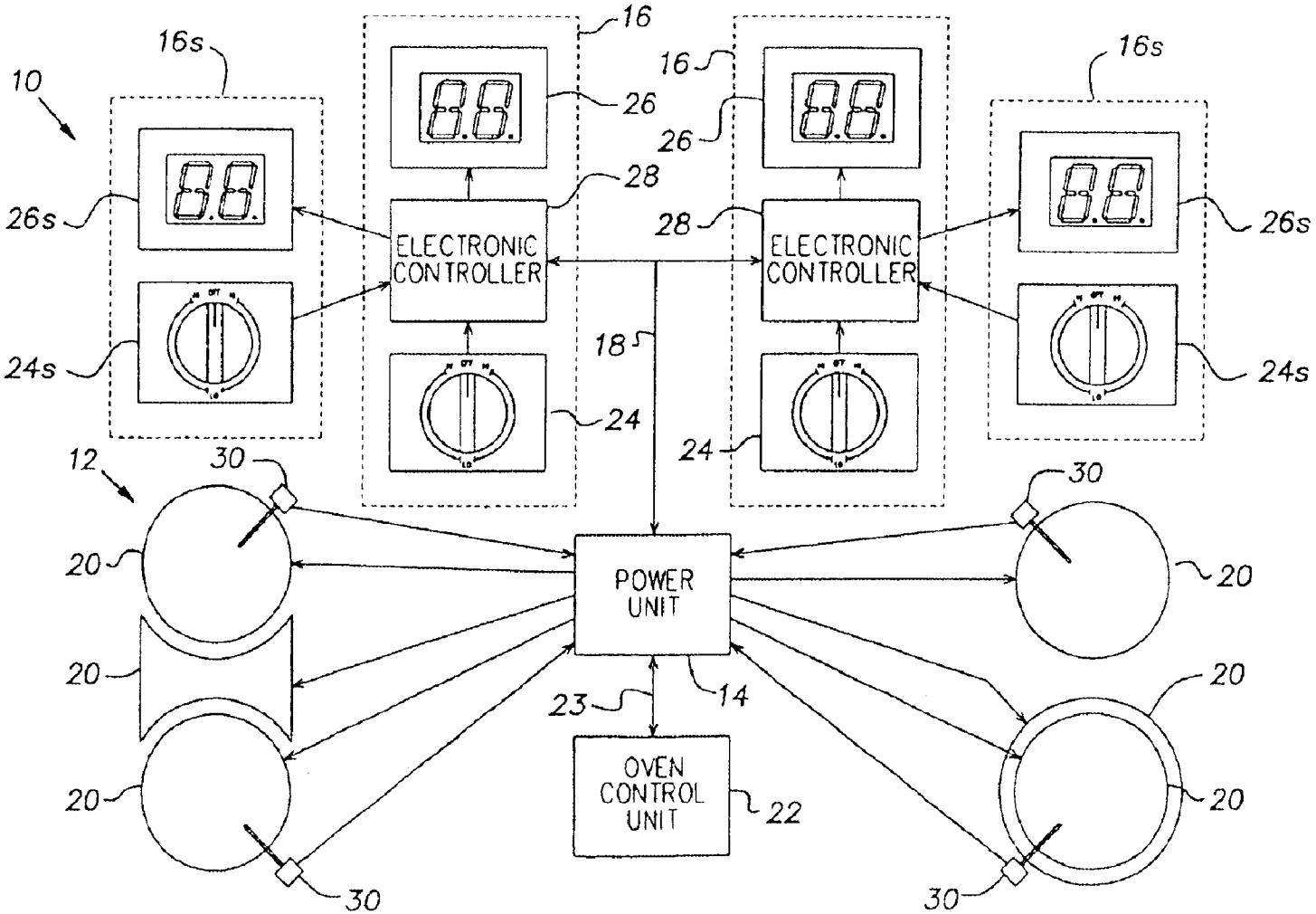
FIG. 1 is a schematic representation of a power control system connected to an electric cooktop according to an embodiment of the present invention.

The present invention provides a rotational control knob to operate a power controller which provides a duty cycle-controlled power output. FIG. 1 is a schematic representation of an embodiment of the present invention in which a power control system 10 is provided for an electric cooktop 12. The power control system 10 includes a power unit 14 and a plurality of user interface units 16, 16*s*. The user interface units 16, 16*s* are connected to the power unit 14 by a communication bus 18 and the power unit 14 is connected to individual heating elements 20 of the cooktop. The heating elements 20 are electrically resistive and are heated by current flowing through them.

The power unit 14 includes an electronic controller for controlling power output to the heating elements 20. Further, the power unit 14 is connected to an electronic oven control unit 22. The oven control unit 22 controls various operations of an oven (not shown), including the initialization of an oven cleaning cycle. The oven control unit 22 communicates bidirectionally with the power unit 14 via a two-line oven control communication bus 23 for synchronizing certain operations between the operation of the oven by the oven control unit 22 and the operation of the cooktop heating elements 20 by the power unit 14. Specifically, by way of the oven control communication bus 23, the power unit 14 is capable of instructing the oven control unit 22 to lockout or prevent the initiation of a cleaning cycle or other operation when one or more of the heating elements 20 are in use. Likewise, the oven control unit 22 is capable of instructing the power unit 14 to lockout the powering of any cooktop heating element 20, such as when a cleaning cycle has been initiated or after a lockout button has been pressed. As used herein, the term "lockout" refers generally to the disabling of control or operation of some aspect of the power control system 10.

Each user interface unit 16, 16*s* includes a potentiometer 24, 24*s* and a power level display 26, 26*s*. Each master user interface unit 16 further includes an electronic controller 28. A knob is attached to manually control the rotation of the potentiometer 24, 24*s*. The potentiometer 24, 24*s* acts as a rotational control input device. An angular position of the potentiometer 24, 24*s*, and thus the knob, is determined by the electronic controller 28 based upon known values representing the relationship between angular position and potentiometer resistance. The angular position is communicated to the power unit 14 via the communication bus 18. Display information is communicated by the power unit 14 back to the electronic controller 28 via the communication bus 18. It is contemplated that other variably resistive devices, such as rheostats, can be substituted for the potentiometers 24, 24*s* according to the present invention.

Each electronic controller 28 controls its respective display 26, 26*s* based upon the display information received from the power unit 14. Each power level display 26, 26*s* is a two-digit seven-segment light-emitting diode (LED) display for indicating a power level or setting based on a level chosen by the user using the respective potentiometer 24, 24*s*. The power level is displayed on the display 26, 26*s* as "LO" indicating the lowest setting, "HI" indicating the highest setting, or as a number from 1.0 to 9.0 in predetermined increments, indicating an intermediate setting. A larger number indicates a higher level of power. The power level display 26, 26*s* is also used for displaying other messages, as further explained herein, including warning messages and error codes. It is contemplated that other types of digital displays can be substituted for the two-digit LED display 26, 26*s*, such as a liquid crystal displays (LCDs), plasma displays, mechanical displays, cathode ray tubes (CRTs), vacuum fluorescent displays (VFDs), discrete LEDs, discrete LEDs arranged in a clock-like fashion, LED bar graphs, and the like.

The display 26, 26*s* is also used in the present embodiment to display a visual indication that the respective heating element 20 has been locked out of operation by displaying "—". The oven control unit 22 includes a buzzer or other audible warning device to emit an audible warning. Further, using the oven control communication bus 23, the power unit 14 can instruct the oven control unit 22 to emit an audible warning tone when a user attempts to operate the heating elements 20 that have been locked out. Thus, the power unit 14 can cause an audible tone to be generated without requiring a separate audible warning device to be provided to the power unit 14.

Figure 1A:
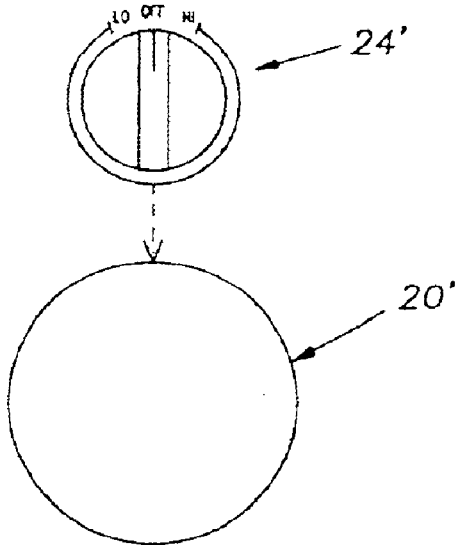
FIG. 1A is a schematic representation of a control scheme of a power control system according to an embodiment of the present invention.

In FIG. 1A, a simple control scheme is illustrated by way of example. The power output to a heating element 20' is controlled by turning a respective potentiometer 24' through its entire or full range of angular rotation. A small segment or range of the angular rotation is used to turn the heating element 20' completely off. The potentiometer 24' is provided with a physical detent, or other tactile indication or the like, to indicate when the "off range" is correctly engaged The term "single potentiometer" is used herein with reference to a potentiometer operating to control a single heating element over the potentiometer's entire range, such as the potentiometer 24' shown in FIG. 1A.

In the embodiment of FIG. 1, the user interface units 16, 16*s* are provided in pairs consisting of a master unit 16 and a slave unit 16*s*. The potentiometer 24*s* and the display 26*s* of the slave unit 16*s* are connected to the controller 28 of the master unit 16. The master unit 16 communicates with the power unit 14 for both user interface units 16, 16*s* via the communication bus 18.

The power unit 14 also delivers pulse width modulated output current to each heating element 20. The power unit 14 controls current and/or voltage to each heating element 20 to produce the desired output power to power the heating elements 20.

The duty cycle of the output current delivered to each heating element 20 is determined by the angular position of a respective one of the potentiometers 24, 24*s*. Duty cycle is expressed as a ratio of current on-time to the period (sum of current on-time and off-time). As explained above, the power level provided to each heating element 20 is displayed on the respective power level display 26, 26*s*.

In the embodiment of FIG. 1, the output power provided to the heating elements 20 is fixed as 240 VAC, which would typically be provided from two-phase utility power. It should be appreciated that maximum output power is equal to the maximum output voltage multiplied by the unmodulated output current. Thus, it is contemplated that the voltage of the output power could also be modulated, in addition to the duty cycle of the current, by the power unit 14 to control the output power. For example switching from 240 VAC to 120 VAC, by utilizing a single phase of the two-phase utility power, could be used to provide additional control, especially for achieving lower power outputs.

For a single potentiometer, such as in the example of FIG. 1A, the relationships between angular position, display information and output power are determined according to Table 1, below. The output power is expressed as a percentage of maximum output power, or the duty cycle times 100 percent.

TABLE 1

| Potentiometer Position | Potentiometer Angle Minimum | Potentiometer Angle Maximum | Power Level Display | Output (% of max power) |
|---|---|---|---|---|
| 1 | 330 | 318 | Lo | 1 |
| 2 | 318 | 306 | 1.0 | 2 |
| 3 | 306 | 294 | 1.2 | 3 |
| . | . | . | . | . |
| . | . | . | . | . |
| . | . | . | . | . |
| 23 | 66 | 54 | 8.5 | 90 |
| 24 | 54 | 42 | 9.0 | 95 |
| 25 | 42 | 30 | Hi | 100 |

Since the power level is controlled electronically, the relationship between the potentiometer angular position and the power output can be nonlinear, and even nonuniform such that the relationship cannot be expressed as an equation. for example, the power level is incremented in steps of 0.2 from 1.0 to 3.0 and in larger steps of 0.5 from 3.0 to 9.0. This allows more control in the lower heating ranges, which is useful for cooking and keeping food warm. Turning the potentiometer to above 330 degrees and below 30 degrees, in the off range, turns the power completely off. As referred to herein, zero degrees is at a 12 o'clock position on the potentiometer and succeeding degrees are measured in a clockwise fashion.

Alternatively, as embodied in the various alternative control schemes of FIGS. 3–8, one potentiometer can be used to control two or more power outputs, and thus two or more heating elements. A potentiometer being used in this way is referred to herein as a "dual potentiometer." According to this alternative embodiment of the present invention, one portion of the total angular rotation of a dual potentiometer controls power to a first element and the other portion of the angular rotation controls power to both the first element and a second element. Table 2, illustrates the operation of a dual potentiometer according to this alternative control scheme.

TABLE 2

| Potentiometer Position | Dual Potentiometer Angle from 0° Left Side Minimum | Left Side Maximum | Right Side Minimum | Right Side Maximum | Power Level Display | Output (% of max. power) |
|---|---|---|---|---|---|---|
| 1 | 196 | 190 | 170 | 164 | Lo | 1 |
| 2 | 201 | 196 | 164 | 159 | 1.0 | 2 |
| 3 | 207 | 201 | 159 | 153 | 1.2 | 3 |
| . | . | . | . | . | . | . |
| . | . | . | . | . | . | . |
| . | . | . | . | . | . | . |
| 23 | 319 | 313 | 47 | 41 | 8.5 | 90 |
| 24 | 324 | 319 | 41 | 36 | 9.0 | 95 |
| 25 | 330 | 324 | 36 | 30 | Hi | 100 |

The specific numbers or values shown in Tables 1 and 2 are given by way of example and can be modified as appropriate to meet the needs of a particular application.

Figure 2:
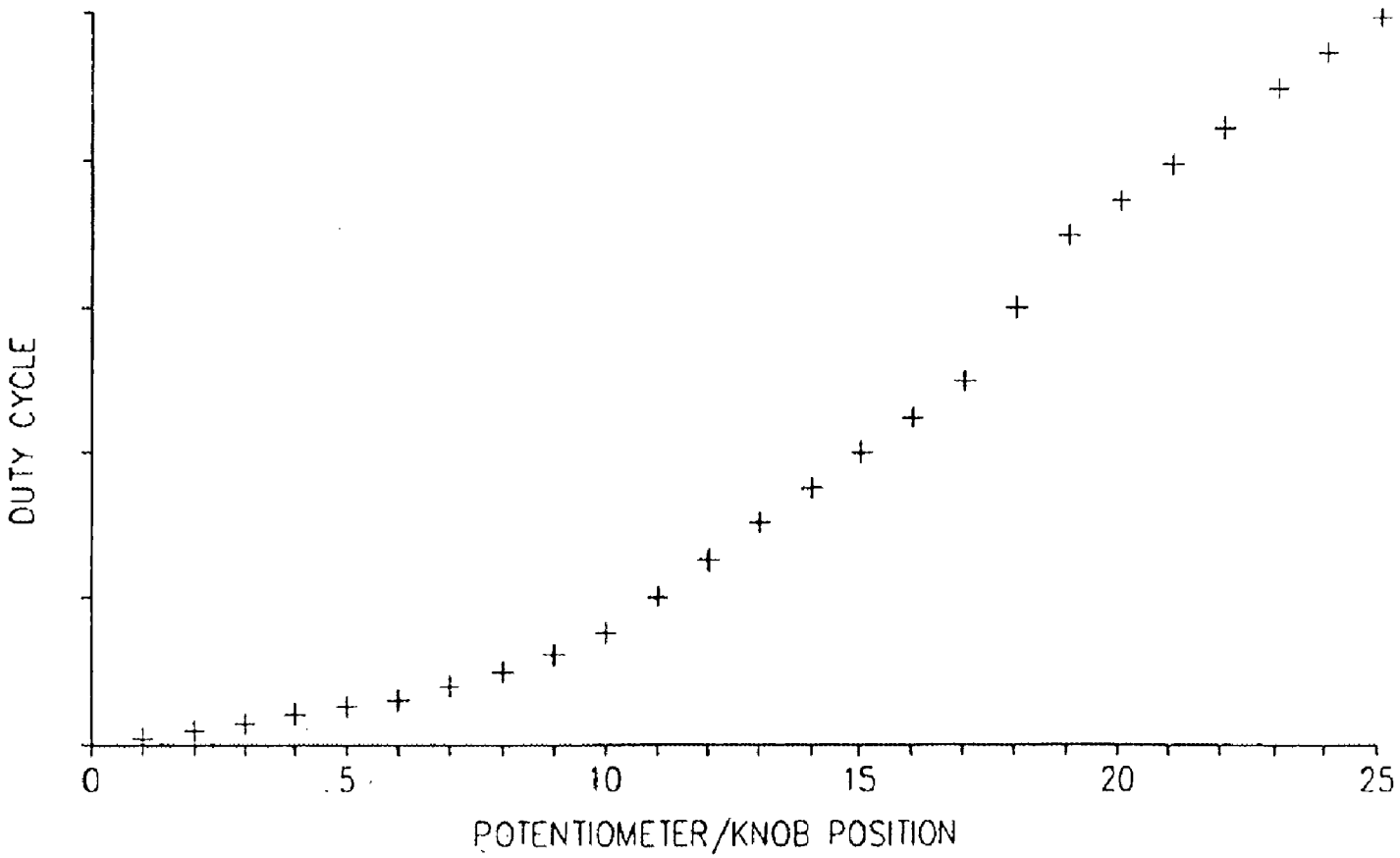
FIG. 2 is plot of power output according to an embodiment of the present invention.

FIG. 2 is a plot of potentiometer position versus duty cycle (in percent of maximum power) as embodied by the control schemes of Tables 1 and 2 above. As set forth in Tables 1 and 2, each "potentiometer position" relates to an angular range of potentiometer rotation. Thus, although the potentiometer rotates smoothly throughout its range, the duty cycle is controlled in discrete steps corresponding to the specific ranges of potentiometer rotation set forth in Tables 1 and 2. The minimum duty cycle of the present embodiment is 1%, as shown in FIG. 2.

Figure 3:
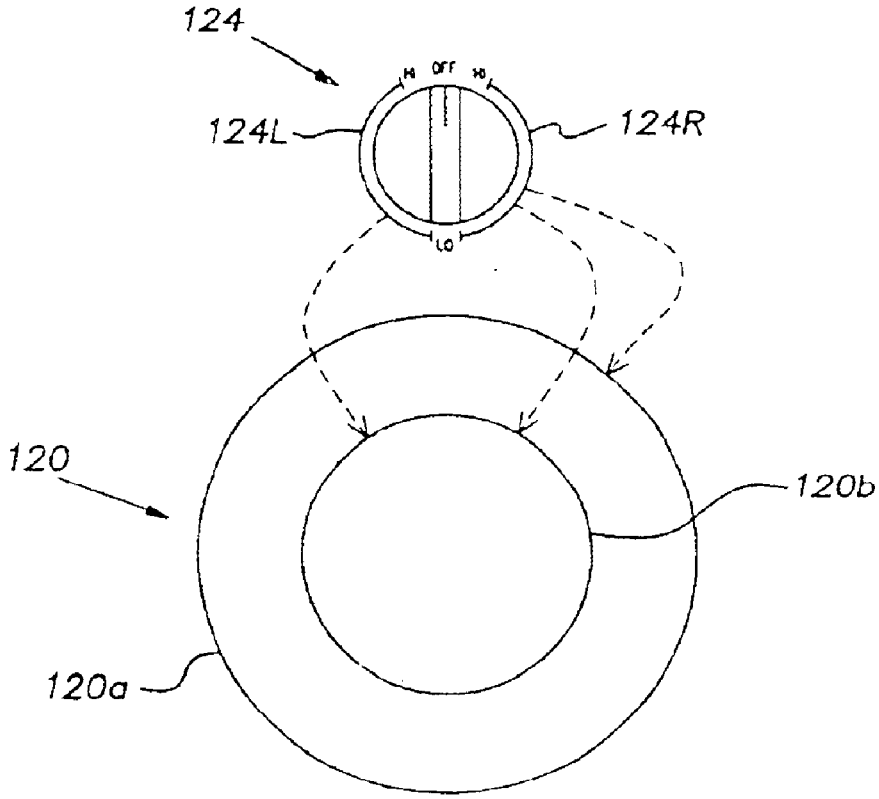
FIG. 3 is schematic representation of a control scheme of a power control system according to another embodiment of the present invention.

FIG. 3 shows another embodiment in which a dual potentiometer 124 is arranged control a dual heating element 120, having concentrically arranged inner heating element 120*b* and outer heating element 120*a*. The left portion 124L of the angular rotation of the dual potentiometer 124, from 190 to 330 degrees, controls power to the inner heating element 120*b* only, and the right portion 124R of the angular rotation of the dual potentiometer 124, from 170 to 30 degrees, controls both heating elements 120*a*, 120*b* simultaneously.

Figure 4:
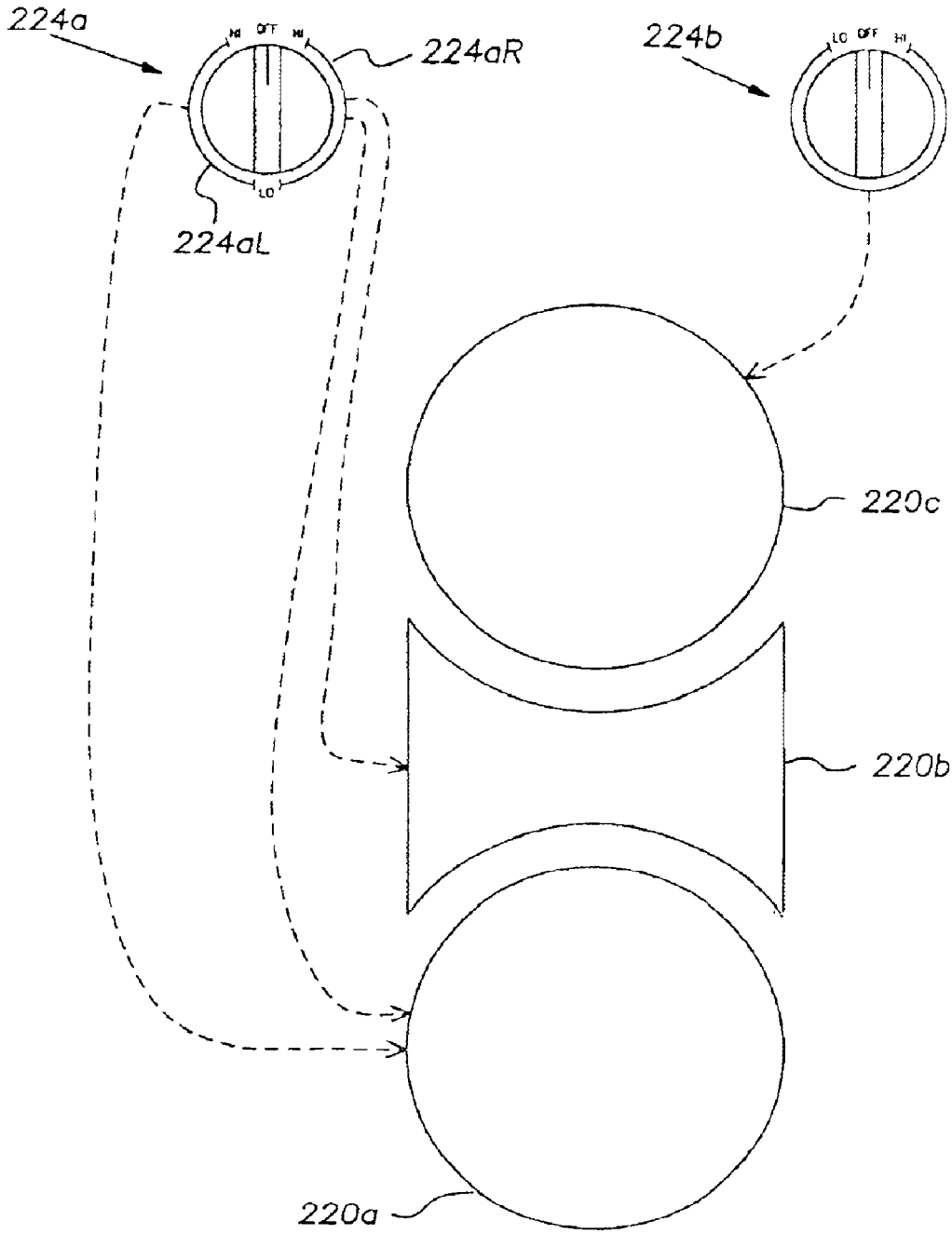
FIG. 4 is schematic representation of a control scheme of a power control system according to a further embodiment of the present invention.

FIG. 4 shows another embodiment using a dual potentiometer 224*a* to control a single heating element 220*a* and a separate bridge heating element 220*b*. The bridge heating element 220*b* provides heating between the single heating element 220*a* and a second heating element 220*c* spaced apart from the single element 220*a*. The dual potentiometer 224*a* operates similarly to the dual potentiometer 124*a* of the embodiment of FIG. 3. Specifically, the left portion 224*a*L of the angular rotation of the dual potentiometer 224*a* controls power to the single heating element 220*a* only, and the right portion 224*a*R of the angular rotation of the dual potentiometer 224*a*, controls both the single heating element 220*a* and the bridge element 220*b* simultaneously. Power to the second single heating element 220*c* is controlled by a single potentiometer 224*b*.

Figure 5:
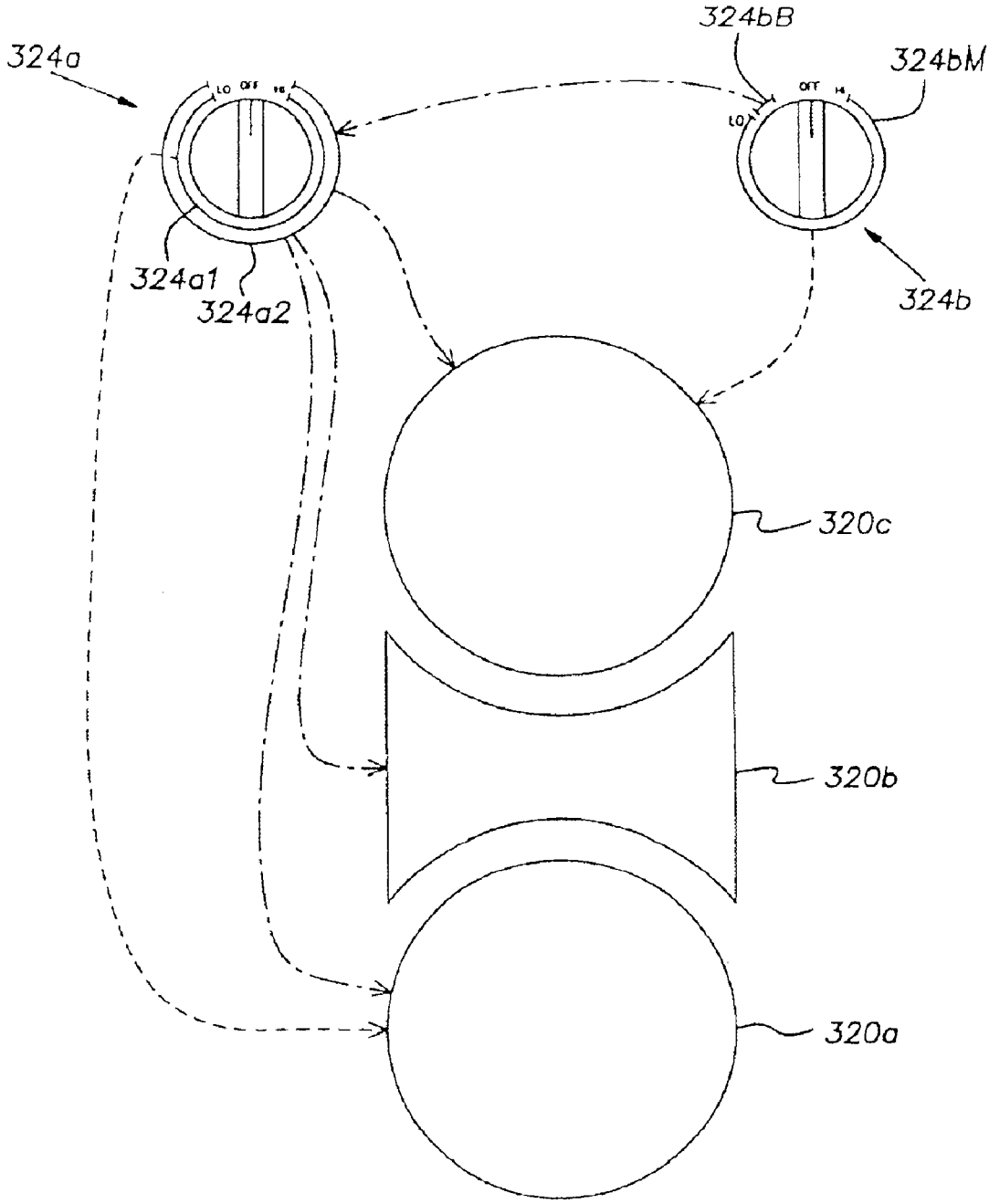
FIG. 5 is schematic representation of a control scheme of a power control system according to a further embodiment of the present invention.

FIG. 5 shows an embodiment using two potentiometers 324*a*, 324*b* to control three heating elements: two single heating elements 320*a*, 320*c* and a bridge heating element 320*b*. The first potentiometer 324*a* controls the first single heating element 320*a* around its entire angular rotation 324*a*1. The second potentiometer 324*b* is a "modified single potentiometer," wherein 324*b* controls the second single heating element 320*c* over most of its angular rotation 324*b*M, except that a small range 324*b*B of the angular rotation is used to enable bridge control. A physical detent, or the like, indicates that the second potentiometer 324*b* is set on the bridge control range 324*b*B. When bridge control is enabled by the second potentiometer 324*b,* the first potentiometer 324*a* simultaneously controls all three heating elements 320*a–c* over its entire angular rotation 324*a*2. This allows all three heating elements 320*a–c* to be easily and accurately set to the same power level.

Figure 6:
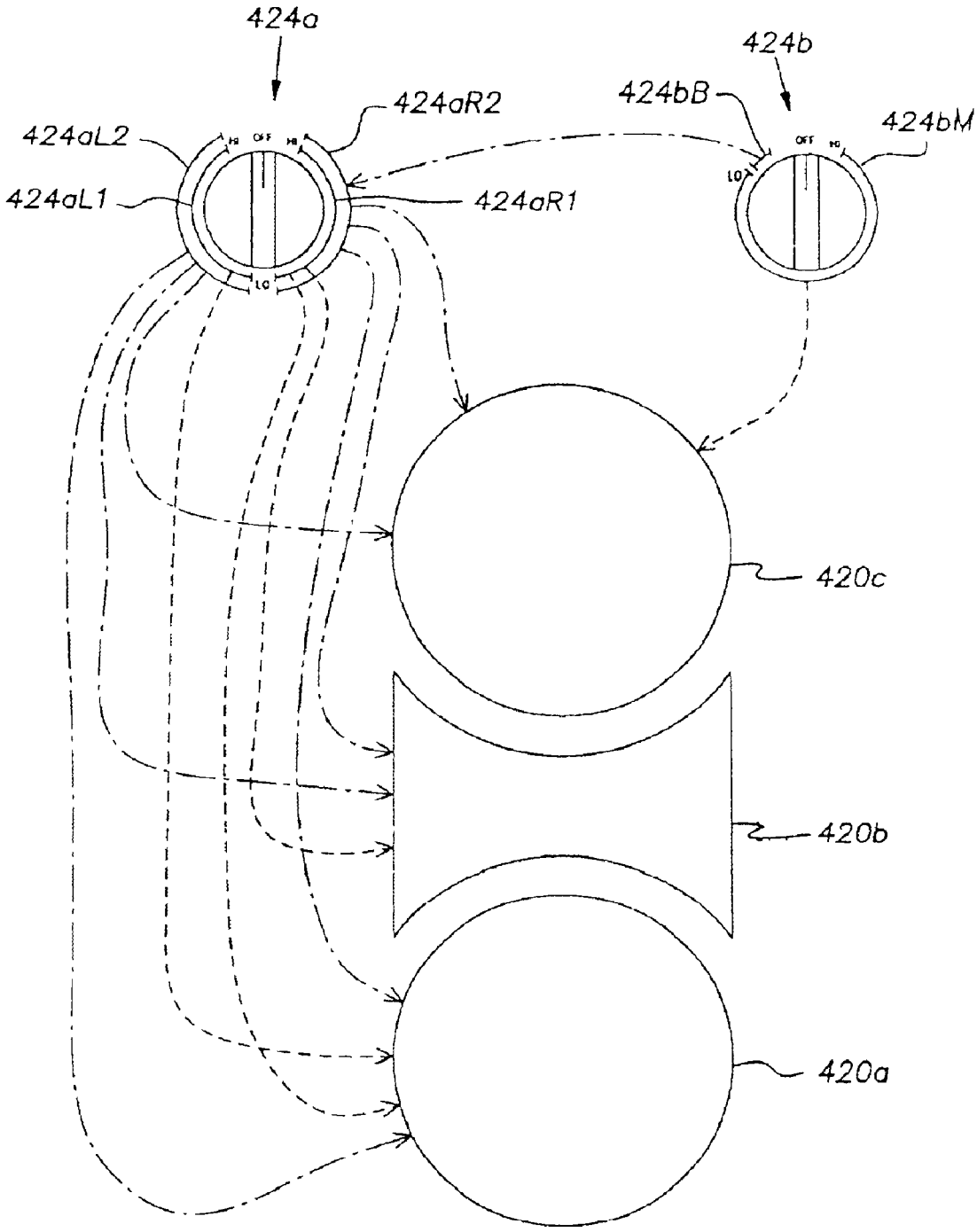
FIG. 6 is schematic representation of a control scheme of a power control system according to a further embodiment of the present invention.

FIG. 6 shows an embodiment which uses principles from both the embodiment of FIG. 4 and the embodiment of FIG. 5. Like the embodiment of FIG. 5, a second potentiometer 424*b,* being a modified single potentiometer, controls only a second single heating element 420*c* over most of its angular rotation 424*b*M and places the first potentiometer 424*a* in bridge control mode at a bridge control range 424*b*B. The first potentiometer 424*a* of FIG. 6 is a dual potentiometer and operates much like the first potentiometer 224*a* of FIG. 4, controlling the first heating element 420*a* over the left portion of rotation 424*a*L1 and controlling both the first heating element 420*a* and the bridge heating element 420*b* over the right portion 424*a*R1 of angular rotation. When the first potentiometer 424*a* of FIG. 6 is placed in bridge mode by the second potentiometer 424*b,* the first potentiometer 424*a* controls all three heating elements 420*a–c* over either portion 424*a*L2, 424*a*R2 of its angular rotation.

Figure 7:
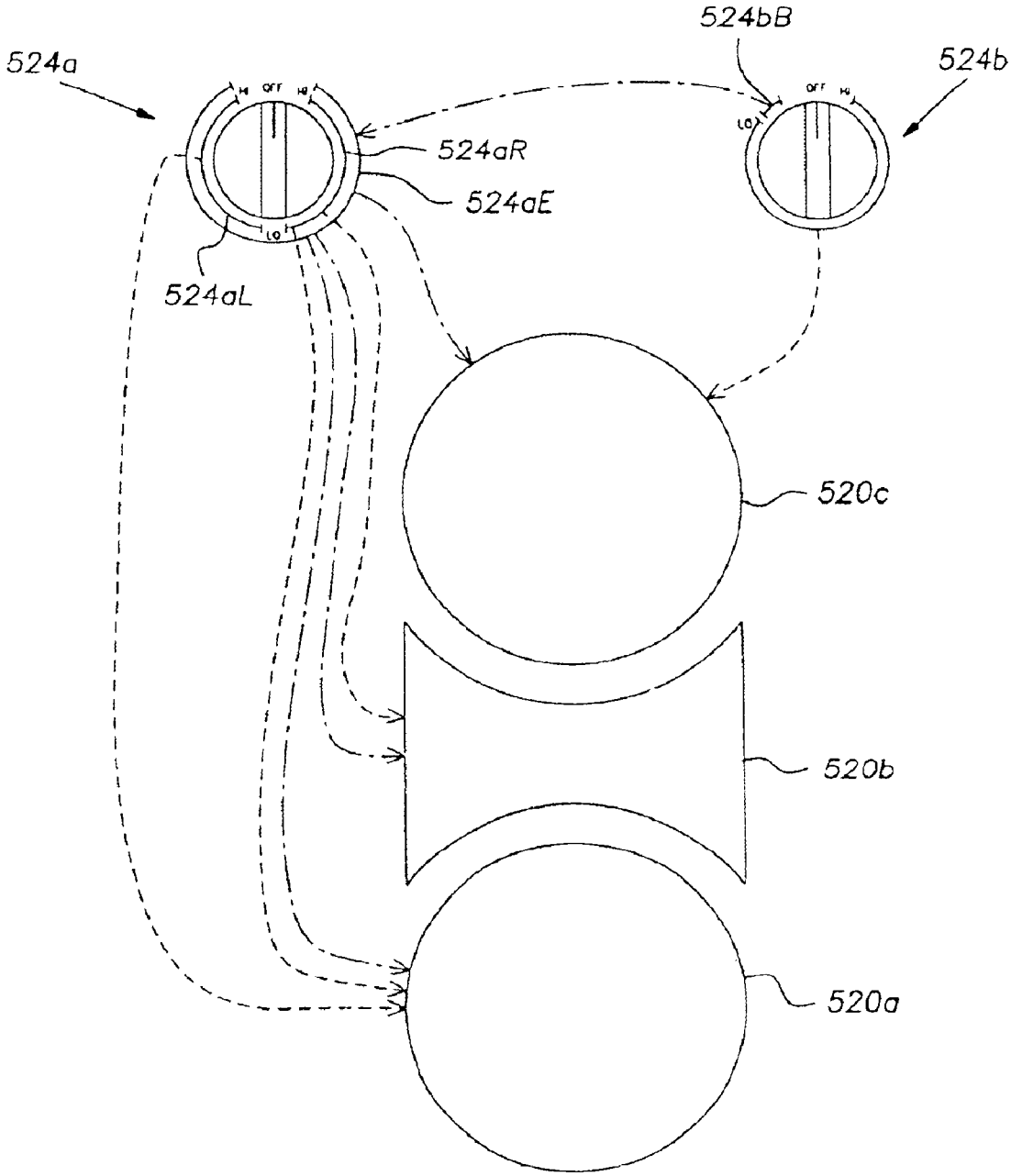
FIG. 7 is schematic representation of a control scheme of a power control system according to a further embodiment of the present invention.

FIG. 7 is a variation on the embodiment of FIG. 6. The first potentiometer 524*a* normally acts as a dual potentiometer, independently controlling the first heating element 520*a* over its left portion 524*a*L and controlling both the bridge element 520*b* and the first heating element 520*a* over its right portion 524*a*R. When bridge control is enabled, the first potentiometer 524*a* acts as a single potentiometer. That is, when the second potentiometer 524*b*, being a modified single potentiometer, is placed in its bridge range 524*b*B, the first potentiometer 524*a* controls all three heating elements 520*a–c* over its entire range 524*a*E of angular rotation. This provides more precise control of power than the scheme of FIG. 6.

Figure 8:
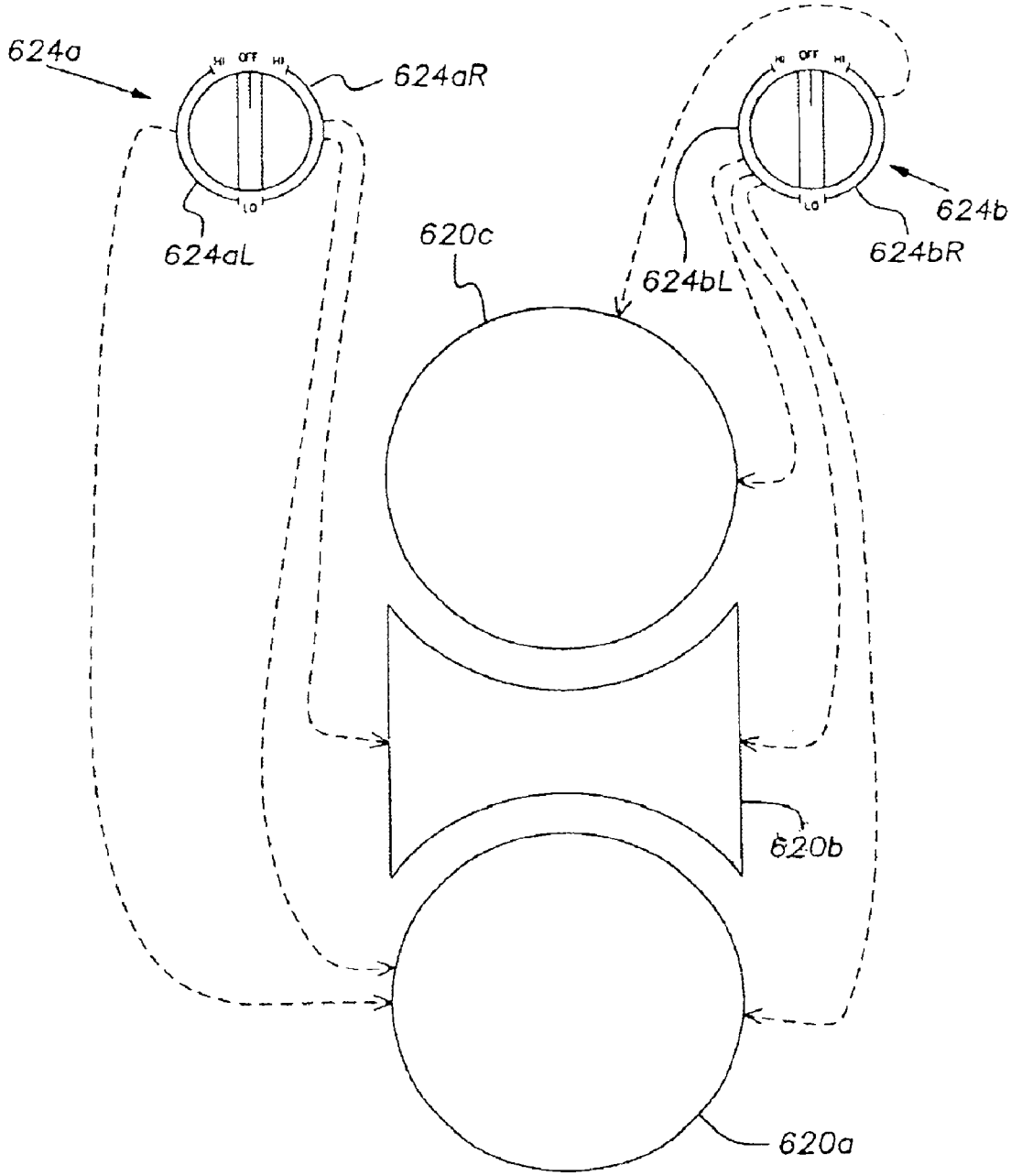
FIG. 8 is schematic representation of a control scheme of a power control system according to a further embodiment of the present invention.

FIG. 8 is an additional embodiment for controlling two single heating elements 620*a*, 620*c* and a bridge heating element 620*b*. First and second potentiometers 624*a*, 624*b* are both dual potentiometers. The first potentiometer 624*a* controls the first single heating element 620*a* over the left portion 624*a*L of its angular rotation and controls both the first single heating element 620*a* and the bridge heating element 620*b* simultaneously over the right portion 624*a*R of its angular rotation. The second potentiometer 624*b* controls the second single heating element 620*c* over the right portion 624*b*R of its angular rotation and controls all three heating elements 620*a–c* simultaneously over the left portion 624*b*L of its angular rotation. When the second potentiometer 624*b* is controlling all three heating elements 620*a–c*, the first potentiometer 624*a* is disabled from controlling any of the heating elements 620*a–c*.

Referring again to FIG. 1, thermal limiters 30 are provided to prevent the heating elements 20 from overheating and potentially causing damage, such as when the heating elements 20 are covered by a flat glass cooking surface. Each limiter 30 comprises two bi-metallic thermostatic switches or limiter elements: a high temperature switch and a low temperature switch.

The high temperature switch in each limiter 30 is connected directly to a corresponding heating element 20. The high temperature switch opens at temperatures above $t_{hi}$, such as 500 degrees Celsius, thus disconnecting power from the heating element 20. Once the heating element 20 cools below $t_{hi}$, the high temperature switch closes, reconnecting power to the heating element 20. It is contemplated that the high temperature switch could be connected in a different manner, for example by being connected via the controller of the power unit 14 rather than directly to the heating element 20.

The low temperature switch in each limiter 30 is connected to the power unit 14. The low temperature switch opens when the temperature falls below $t_{lo}$, such as 50 or 70 degrees Celsius. When the low temperature switch is closed, the power unit 14 causes a heat warning to be displayed on the seven-segment power level display 26, 26*s* , such as "HE" for element, "HS" for hot surface, "HC" for hot cooktop, or other appropriate display, indicating that the cooking surface at the respective heating element 20 is too hot to touch. Alternatively, a warning lamp or indicator could be used to display the heat warning.

As a further alternative, the low temperature switch or limiter element can be replaced by a timing mechanism which causes the heat warning to be displayed for a predetermined period of time, after which the respective heating element 20 should have predictably fallen below $t_{lo}$. The timing mechanism can be implemented by the electronic controller of the power unit 14, or by some other known means. Nonvolatile memory, such as an EEPROM, can be provided to the power unit 14 to retain timing information in the event of a power failure.

Figure 9:
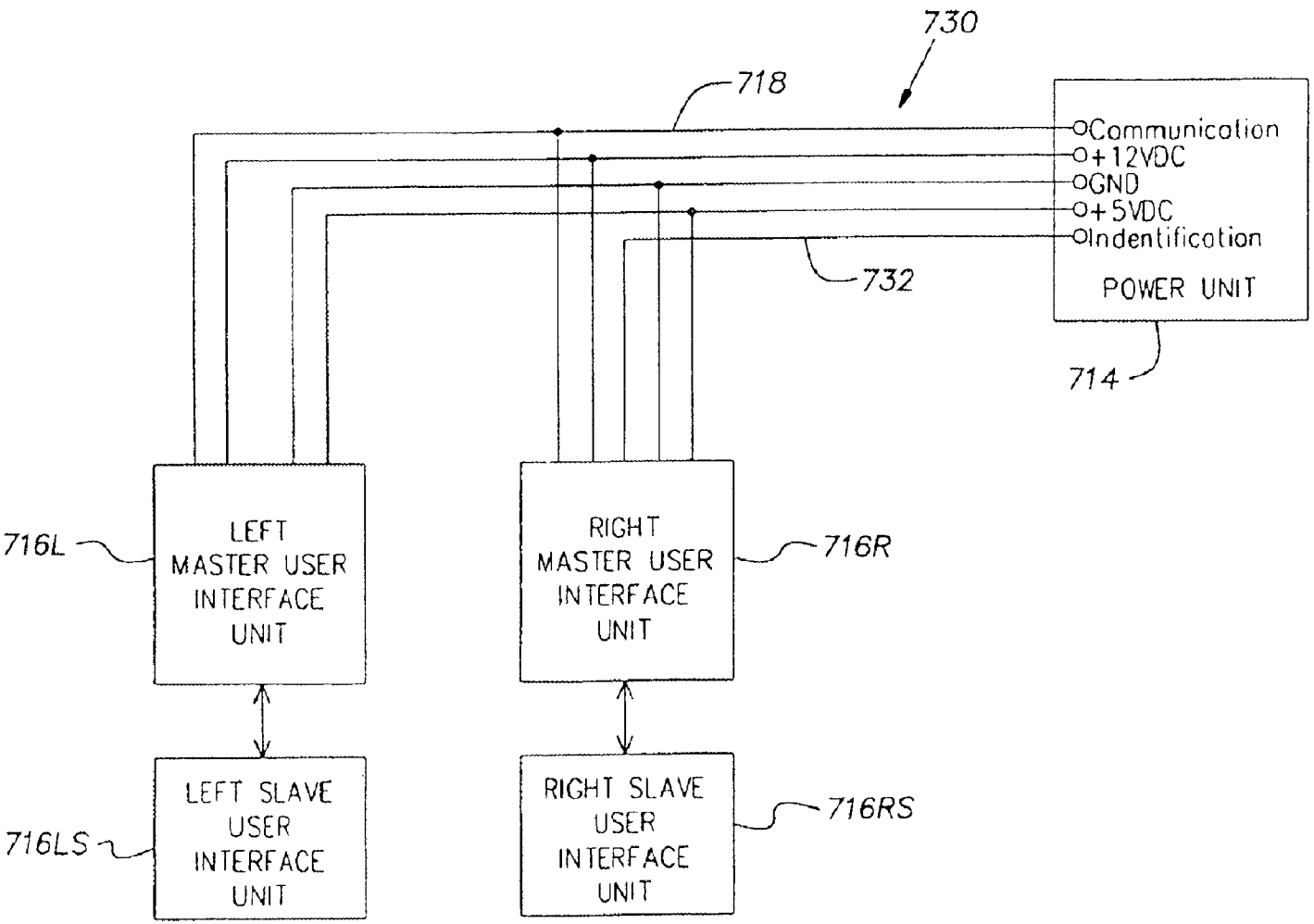
FIG. 9 is a schematic representation of power and communication connections of a power unit and user interface units according to an embodiment of the present invention.

FIG. 9 illustrates a communication and power connection arrangement according to an embodiment of the present invention including a power board 714 and two master user interface units 716L, 716R. Communication between the master user interface units 716L, 716R and the power board 714 is accomplished by a one wire serial communication bus or wire 718 provided in a wiring harness 730. In addition to the communication wire 718, the 5-wire harness 730 also includes +12 VDC, ground, +5 VDC, and an identification wire. With the exception of the identification wire, each of the 5 wires is connected from the power unit 714 to each of the master user interface units 716L, 716R.

The identification wire 732 carries a +5V identification signal from the power unit 714 to the right master user interface unit 716R, telling the unit 716R that its position is "right." Since there is no connection between the identification wire 732 and the left master user interface unit 716L, the unit 716L will not receive the identification signal, causing the unit 716L to identify its position as "left." It should be appreciated that the "right" and "left" positions can be transposed without departing from the present invention.

Potentiometer angle information from a master interface unit 716L, 716R or a slave user interface unit 716LS, 716RS is digitally encoded by the microprocessor in the respective master user interface unit 716R, 716S and sent to the power unit 714 via the communication bus 718, similarly to that described above with reference to FIG. 1. Likewise, digital display information is sent from the power unit 714 to the user interface units 716L, 716R via the communication bus 718. An identification code is included in each communication to identify the sender or recipient user interface unit as the left master unit 716L, the left slave unit 716LS, the right master unit 716R, the right slave unit 716RS. The identification code also indicates whether the corresponding potentiometer is being used as a single or dual potentiometer, whereby the power board 714 controls the user interface unit 716 and its corresponding heating element according to the appropriate set of data, as exemplified in Tables 1 and 2.

A 3-bit identification code is shown in the following table:

TABLE 3

| Description | Left/Right Pair ($b_2$) | Master/Slave Unit ($b_1$) | Single/Dual Element ($b_0$) |
|---|---|---|---|
| Left pair, Master unit, Single element | 0 | 0 | 0 |
| Left pair, Master unit, Dual element | 0 | 0 | 1 |
| Left pair, Slave unit, Single element | 0 | 1 | 0 |
| Left pair, Slave unit, Dual element | 0 | 1 | 1 |
| Right pair, Master unit, Single element | 1 | 0 | 0 |
| Right pair, Master unit, Dual element | 1 | 0 | 1 |
| Right pair, Slave unit, Single element | 1 | 1 | 0 |
| Right pair, Slave unit, Dual element | 1 | 1 | 1 |

The remaining wires in the wiring harness 730 are used for providing operating voltages to the user interface units 716L, 716LS, 716R, 716RS.

It should be evident that this disclosure is byway of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A power control system for an electric heating element, the control system comprising:

a communication bus;

a controller connected to the communication bus;

a variably resistive device connected to the controller;

a digital display connected to the controller; and a power unit connected to the communication bus, the power unit haying a power output;

wherein the variably resistive device controls a level of the power output, and wherein a relationship between rotation of the first variably resistive device and the level of the power output is nonlinear.

2. A power control system for an electric heating element, the control system comprising:

a communication bus;

a controller connected to the communication bus;

a variably resistive device connected to the controller;

a digital display connected to the controller; and a power unit connected to the communication bus, the power unit having a power output;

wherein the power unit has a second power output, and wherein:

a position of the variably resistive device in a first range of angular rotation controls a level of the first power output; and a position of the variably resistive device in a second range of angular rotation controls a level of the second power output.

3. A power control system for an electric heating element, the control system comprising:

a communication bus;

a controller connected to the communication bus;

a variably resistive device connected to the controller;

a digital display connected to the controller; and a power unit connected to the communication bus, the power unit having a first power, output and a second power output;

wherein:

a position of the variably resistive device in a first range of angular rotation controls a level of the first power output; and a position of the variably resistive device in a second range of angular rotation concurrently controls the level of the first power output and a level of the second power output.

4. The control system of claim 3, further comprising:

a second variably resistive device; and a third power output of the power unit;

wherein:

a position of the second variably resistive device in a first range of angular rotation controls a level of the third power output; and a position of the second variably resistive device in a second range of angular rotation disables control by the first variably resistive device and concurrently controls the level of the first power output, the level of the second power output, and the level of the third power output.

5. The control system of claim 3, further comprising a heating element comprising a first subelement connected to said power output and a second subelement connected to said second power output.

6. The control system of claim 5, further comprising a thermal limiter operatively associated with the heating element.

7. A power control system for an electric heating element, the control system comprising:

a communication bus;

a controller connected to the communication bus;

a first variably resistive device connected to the controller;

a digital display connected to the controller; and a power unit connected to the communication bus, the power unit having a first power output, a second power output, and a third power output; and a second variably resistive device;

wherein:

the first variably resistive device controls a level of the first power output;

a position of the second variably resistive device in a first range of angular rotation controls a level of the second power output; and a position of the second variably resistive device in a second range of angular rotation causes the first variably resistive device to concurrently control the level of the first power output, a level of the second power output and a level of the third power output.

8. The control system of claim 7, wherein:

a position of the first variably resistive device in a first range of angular rotation controls the level of the first power output; and a position of the first variably resistive device in a second range of angular rotation controls the level of the second power output.

9. The control system of claim 8, wherein the position of the first variably resistive device in the second range of angular rotation concurrently controls the level of the first power output and the level of the second power output.

10. The control system of claim 7, wherein the position of the second variably resistive device in the second range of angular rotation causes a position of the first variably resistive device in a first range of angular rotation to concurrently control the level of the first power output, the level of the second power output and the level of the third power output; and wherein the position of the second variably resistive device in the second range of angular rotation causes a position of the first variably resistive device in a second range to concurrently control the level of the first power output, the level of the second power output and the level of the third power output.

11. A power control system for controlling a plurality of heating elements, the control system comprising:

a first rotational control input having a first range of angular rotation and a second range of angular rotation;

a first heating element; and a second heating element;

wherein a position of the control input in the first range controls the first heating element and a position of the control input in the second range controls the second heating element.

12. The control system of claim 11, further comprising a thermal limiter associated with one of the first heating element and the second heating element.

13. The control system of claim 11, wherein the position of the control input in the second range concurrently controls the first heating element and the second heating element.

14. The control system of claim 13, wherein the second heating element surrounds the first heating element.

15. The control system of claim 11, further comprising a third heating element; and wherein the second heating element is a bridge element located between the first heating element and the third heating element.

16. The control system of claim 15, further comprising a second rotational control input having a first range of angular rotation and a second range of angular rotation;

wherein a position of the second control input in the first range controls the third heating element; and wherein a position of second control input in the second range disables control by the first control input and concurrently controls the first heating element, the second heating element, and the third heating element.

17. A power control system for controlling a plurality of heating elements, the control system comprising:

a first rotational control input;

a second rotational control input having a first range of angular rotation and a second range of angular rotation;

a first heating element;

a second heating element; and a third heating element;

wherein the second heating element is a bridge element positioned between the first element and the third element;

wherein the first control input controls the first heating element;

wherein a position of the second control input in the first range controls the third heating element; and wherein a position of the second control input in the second range causes the first control input to concurrently control the first heating element, the second heating element, and the third heating element.

18. The control system of claim 17, further comprising a thermal limiter operatively associated with at least one of the first heating element, the second heating element, and the third heating element.

19. The control system of claim 17, wherein the first rotational control input has a first range of angular rotation and a second range of angular rotation; wherein the a position of the first control input in the first range controls the first heating element; and wherein a position of the first control input in the second range concurrently controls the first heating element and the second heating element.

20. The control system of claim 19, wherein the position of the second control input in the second range causes each of the position of the first control input in the first range and the position of the first control input in the second range to concurrently control the first heating element, the second heating element, and the third heating element.

21. The control system of claim 19, wherein the position of the second control input in the second range causes a position of the first control input in a full range of the first control input to concurrently control the first heating element, the second heating element, and the third heating element.

22. A power control system for an electric heating element, the control system comprising:

a communication bus;

a controller connected to the communication bus;

a control input device connected to the controller, the control input device having a first control range and a second control range;

a digital display connected to the controller; and a power unit connected to the communication bus, the power unit having a power output;

wherein over the first control range, incrementing the control input device by one power setting level causes the power unit increase a power output level by a first step size; and wherein over the second control range, incrementing the control input device by one power setting level causes the power unit to increase a power output level by a second step size being greater than the first step size.

23. The power control system of claim 22 wherein the control input device comprises a variable resistive device.

24. The power control system of claim 22 wherein the control input device comprises a rotational control device.

25. The power control system of claim 22 wherein setting the control input device within the second control range results in greater power output than setting the control input device within the first control range.

26. A power control system for controlling power to electrical heating elements, the system comprising:

a communication bus;

a first power controller for controlling power to a heating element of an oven, the first power controller being connected to the communication bus;

a second power controller for controlling power to a heating element of a cooktop, the second power controller being connected to the communication bus;

wherein when one of the first power controller and the second power controller initiates a lockout condition, the other one of the first power controller and the second power controller initiates a corresponding lockout condition in response to a lockout signal being provided on the communication bus.

27. The system of claim 26, wherein the lockout condition is initiated for the purpose of at least one of:

preventing operation of the second power controller during a self-cleaning operation of the first power controller; and preventing initiation of the self-cleaning operation of the first power controller during a heating operation of the second power controller.

* * * * *